US010875559B2

(12) United States Patent
Gao et al.

(10) Patent No.: US 10,875,559 B2
(45) Date of Patent: Dec. 29, 2020

(54) PRECEDING TRAIN IDENTIFICATION METHOD BASED ON OBJECT CONTROLLER, VEHICLE ON BOARD CONTROLLER AND TRAIN

(71) Applicant: Traffic Control Technology Co., Ltd, Beijing (CN)

(72) Inventors: Chunhai Gao, Beijing (CN); Bo Liu, Beijing (CN)

(73) Assignee: Traffic Control Technology Co., Ltd, Beijing (CN)

( * ) Notice: Subject to any disclaimer, the term of this patent is extended or adjusted under 35 U.S.C. 154(b) by 265 days.

(21) Appl. No.: 16/070,523

(22) PCT Filed: Dec. 19, 2016

(86) PCT No.: PCT/CN2016/110780
§ 371 (c)(1),
(2) Date: Jul. 17, 2018

(87) PCT Pub. No.: WO2018/107508
PCT Pub. Date: Jun. 21, 2018

(65) Prior Publication Data

US 2019/0054940 A1 Feb. 21, 2019

(30) Foreign Application Priority Data

Dec. 12, 2016 (CN) ..... 2016 1 1140827

(51) Int. Cl.
*B61L 27/04* (2006.01)
*B61L 27/00* (2006.01)
(Continued)

(52) U.S. Cl.
CPC ..... *B61L 27/0038* (2013.01); *B61L 1/16* (2013.01); *B61L 15/00* (2013.01);
(Continued)

(58) Field of Classification Search
CPC ..... B61L 23/00; B61L 23/08; B61L 23/22; B61L 22/34; B61L 25/00; B61L 25/02;
(Continued)

(56) References Cited

U.S. PATENT DOCUMENTS 6,459,965 B1 * 10/2002 Polivka ..... B61L 27/0038 180/168
7,756,613 B2 * 7/2010 Katsuta ..... B61L 11/08 246/14
(Continued)

FOREIGN PATENT DOCUMENTS

CN 102082819 A 6/2011
CN 102085874 A 6/2011
(Continued)

OTHER PUBLICATIONS

Ansaldo STS SpA, "Interlocking Solutions", published in 2016, 9 pages.
(Continued)

*Primary Examiner* — Robert J McCarry, Jr.
(74) *Attorney, Agent, or Firm* — Law Offices of Liaoteng Wang

(57) ABSTRACT

The present disclosure discloses a preceding train identification method based on an object controller, a vehicle on board controller and a train. The method includes: carrying out communication interaction, by a vehicle on board controller of a train, with the OC to acquire the ID information of all running trains within the jurisdiction of the OC, before the train enters the jurisdiction of the object controller OC; communicating, by the vehicle on board controller, with the train corresponding to each piece of ID information according to the ID information of all running trains to acquire the position information of the train corresponding to each piece of ID information; and sorting, by the vehicle on board controller, the position information of the trains correspond-
(Continued)

ing to all ID information in an axle counter sorting manner to identify the ID information of an adjacent preceding train of a present train.

9 Claims, 4 Drawing Sheets

(51) Int. Cl.

| | |
|---|---|
| ***B61L 25/02*** | (2006.01) |
| ***B61L 25/04*** | (2006.01) |
| ***B61L 15/00*** | (2006.01) |
| ***B61L 1/16*** | (2006.01) |

(52) U.S. Cl.
CPC ..... *B61L 15/0018* (2013.01); *B61L 15/0027* (2013.01); *B61L 25/025* (2013.01); *B61L 25/04* (2013.01); *B61L 2027/005* (2013.01)

(58) Field of Classification Search
CPC ..... B61L 25/021; B61L 25/023; B61L 25/04; B61L 27/00; B61L 27/0077
See application file for complete search history.

(56) References Cited

U.S. PATENT DOCUMENTS

| | | | | |
|---|---|---|---|---|
| 9,151,232 | B2 * | 10/2015 | Kumar | F02D 19/0639 |
| 9,828,010 | B2 * | 11/2017 | Otsubo | B61L 3/006 |
| 9,834,237 | B2 * | 12/2017 | Plotnikov | B61L 3/18 |
| 2002/0062181 | A1 | 5/2002 | Polivka et al. | |
| 2012/0056042 | A1 | 3/2012 | Denny et al. | |

FOREIGN PATENT DOCUMENTS

| | | | |
|---|---|---|---|
| CN | 102963399 | A | 3/2013 |
| CN | 103764481 | A | 4/2014 |
| CN | 105101094 | A | 11/2015 |
| CN | 105329264 | A | 2/2016 |
| CN | 105398476 | A | 3/2016 |
| EP | 0625947 | B2 | 5/2000 |
| EP | 1366967 | A2 | 12/2003 |
| EP | 2733042 | A2 | 5/2014 |
| WO | 2016146365 | A1 | 9/2016 |

OTHER PUBLICATIONS

Siemens Rail Automation Pty Ltd, "Trackguard Westrace Object Controller", published in 2014, 2 pages.
https://www.indiamart.com/proddetail/object-controller-based-electronic-interlocking-5672244530.html.
https://www.railwaygazette.com/news/signalling-under-contro1/31795.article.
PCT International Search Report for PCT/CN2016/110780, dated Sep. 15, 2017, 12 pages.
First Office Action dated Jan. 19, 2018 and first Search Report in Chinese Patent Application No. 201611140827.8, and concise English-language summary thereof, 9 pages.
The extended European search report dated Sep. 2, 2019 for European Application No. 16924025.6, 7 pages.

* cited by examiner

PRECEDING TRAIN IDENTIFICATION METHOD BASED ON OBJECT CONTROLLER, VEHICLE ON BOARD CONTROLLER AND TRAIN

CROSS-REFERENCE TO RELATED APPLICATION

This application is based upon and claims priority to Chinese Patent Application No. 2016111408278, filed on Dec. 12, 2016, the content of which is incorporated herein by reference in its entirety.

TECHNICAL FIELD

The present disclosure relates to the technical field of communications, and particularly relates to a preceding train identification method based on an object controller, a vehicle on board controller and a train.

BACKGROUND

The architecture of a traditional CBTC (Communication Based Train Control System) is shown in FIG. 1. The CBTC mainly includes: equipment (e.g., a control center) located in a control center for realizing automatic train monitoring, a wireless transmission network (e.g., Distributed Control System, referred to as DCS), on-board equipment and ground equipment. The ground equipment includes: a ZC (Zone Controller), an interlocking system CI, a trackside signal machine, a trackside axle counter, a trackside transponder, etc.

The traditional CBTC system takes ground control as the mainstay, a train registers the ground ZC, initiatively accepts the control of the ZC and initiatively reports a position to the ZC, the ZC calculates movement authorization (MA) for the train within the jurisdiction, train-ground information interaction is achieved by continuous train-ground two-way wireless communication, and tracking operation in a movable block system based on target-distance is achieved.

The aforementioned control manner taking the ground control as the mainstay embodies the idea of centralized control, the ground ZC calculates the movement authorization to realize centralized management of pass and return operations of the train. The train initiatively reports the position to the ZC. The ZC carries out train sorting according to the positions of the trains, calculates an adjacency relation between the trains on a route and calculates the MA for a rear train according to the tail of a preceding train.

In practical application, the ZC needs to screen and sort the trains within the jurisdiction and identify the position of each train and the adjacency relation between the trains, and since train-ground transmission has a certain delay, a certain accumulated error is generated from the information to a vehicle on board controller to the ZC and then from the ZC to the vehicle on board controller.

To this end, the next generation train control system based on train-train communication breaks through the centralized train running control theory of the traditional zone controller, and establishes a brand new decentralized control manner taking autonomous control of the train as the core. As shown in FIG. 2, on the basis of a movable block signal control system based on the CBTC, ZC and CI subsystems are integrated in the vehicle on board controller of the on-board equipment from system architecture, and by means of a direct communication manner of the preceding train and the rear train, the train acquires the position, a running speed and other information of the preceding train, autonomously calculates the speed of the MA that controls the present train and achieves the tracking operation with the preceding train. However, in the decentralized control manner taking the autonomous control of the train as the mainstay, the train needs to know the running of adjacent trains on the route to achieve the tracking operation based on the position of the preceding train. Therefore, adjacent trains in front need to be identified in a way.

SUMMARY

The present disclosure provides a preceding train identification method based on an object controller, including: carrying out communication interaction, by a vehicle on board controller of a train, with the OC to acquire the ID information of all running trains within the jurisdiction of the OC, before the train enters the jurisdiction of the object controller OC; communicating, by the vehicle on board controller, with the train corresponding to each piece of ID information according to the ID information of all running trains to acquire the position information of the train corresponding to each piece of ID information; and sorting, by the vehicle on board controller, the position information of the trains corresponding to all ID information in an axle counter sorting manner to identify the ID information of an adjacent preceding train of a present train.

Optionally, the step of carrying out communication interaction, by a vehicle on board controller of a train, with the OC to acquire the ID information of all running trains within the jurisdiction of the OC includes: establishing, by the vehicle on board controller of the train, a communication connection with the OC, wherein the ID information of all trains running within the jurisdiction of the OC is stored in the OC; sending, by the vehicle on board controller, a request of acquiring the ID information of all running trains within the jurisdiction of the OC to the OC; and receiving, by the vehicle on board controller, a response including the ID information of all running trains returned by the OC according to the request, and acquiring the ID information of all running trains within the jurisdiction of the OC.

Optionally, the step of communicating, by the vehicle on board controller, with the train corresponding to each piece of ID information according to the ID information of all running trains to acquire the position information of the train corresponding to each piece of ID information includes: sending, by the vehicle on board controller, a communication request of acquiring the position information of the train to the train corresponding to the ID information in view of each piece of ID information of all running trains; and receiving, by the vehicle on board controller, communication reply information returned by the train corresponding to the ID information according to the communication request, wherein the communication reply information includes the ID information of the train and axle counter offset information of the train; or the communication reply information includes the ID information of the train, the axle counter offset information of the train and a running direction of the train.

Optionally, if the communication reply information includes the ID information of the train and the axle counter offset information of the train, then the step of sorting, by the vehicle on board controller, the position information of the trains corresponding to all ID information in an axle counter sorting manner to identify the ID information of an adjacent preceding train of a present train includes: sorting, by the vehicle on board controller, axle counter information within the jurisdiction of the OC, wherein the axle counter information within the jurisdiction of the OC is acquired by the vehicle on board controller by interacting with the OC in advance; matching the ID information of each train with the sorted axle counter information according to the axle counter offset information of all trains, and determining a sorting sequence of the trains corresponding to all ID information; and identifying the ID information of the adjacent preceding train of the present train according to the sorting sequence of the trains corresponding to all ID information; wherein the axle counter offset information of each train includes an axle counter offset of the head of the train and the axle counter offset of the tail of the train.

Optionally, if the communication reply information includes the ID information of the train, the axle counter offset information of the train and the running direction of the train, then the step of sorting, by the vehicle on board controller, the position information of the trains corresponding to all ID information in an axle counter sorting manner to identify the ID information of an adjacent preceding train of a present train includes: sorting, by the vehicle on board controller, axle counter information within the jurisdiction of the OC, wherein the axle counter information within the jurisdiction of the OC is acquired by the vehicle on board controller by interacting with the OC in advance; acquiring the ID information of the train that is consistent with the running direction of the present train according to the running directions of all trains; matching the ID information of each train having the consistent running direction with the sorted axle counter information according to the ID information of each train having the consistent running direction and the axle counter offset information of the train, and determining a sorting sequence of the trains corresponding to all ID information; and identifying the ID information of the adjacent preceding train of the present train according to the sorting sequence of the trains corresponding to all ID information.

Optionally, after the step of acquiring the ID information of all running trains within the jurisdiction of the OC, the method further includes: acquiring the axle counter information within the jurisdiction of the OC.

Optionally, the method further includes: establishing, by the vehicle on board controller, a communication connection with the identified adjacent preceding train to acquire the running state information of the adjacent preceding train.

Optionally, the step of establishing, by the vehicle on board controller of the train, a communication connection with the OC includes: determining, by the vehicle on board controller, identification information of a next OC adjacent to the present OC during running on the route according to electronic map information; and establishing the communication connection with the OC according to the identification information of the next OC.

In a second aspect, the present disclosure further provides a vehicle on board controller, including: an ID information acquisition unit, used for carrying out communication interaction with an OC to acquire the ID information of all running trains within the jurisdiction of the OC, before a train enters the jurisdiction of the object controller OC; a position information acquisition unit, used for communicating with the train corresponding to each piece of ID information according to the ID information of all running trains to acquire the position information of the train corresponding to each piece of ID information; and an identification unit, used for sorting the position information of the trains corresponding to all ID information in an axle counter sorting manner to identify the ID information of an adjacent preceding train of a present train.

In a third aspect, the present disclosure further provides a train, including a train body and any aforementioned vehicle on board controller located on the train body.

DETAILED DESCRIPTION

In order that the objectives, technical solutions and advantages of the embodiments of the present disclosure are clearer, a clear and complete description of technical solutions in the embodiments of the present disclosure will be given below, in combination with the accompanying drawings in the embodiments of the present disclosure. Apparently, the embodiments described are merely a part, but not all, of the embodiments of the present disclosure.

It should be noted that the words "first", "second", "third" and "fourth" herein are only used for distinguishing identical names, rather than implying a relationship or a sequence of these names.

At present, in a movable block system based on train-train communication, a train autonomously identifies a preceding train through an object controller (OC), and the train only needs to know the information of the preceding train to achieve tracking based on the position of the preceding train in a normal running process. Compared with a traditional CBTC system, it has the following advantages:

(1) the system complexity is reduced, a ground ZC subsystem and a CI subsystem are integrated to be on-board, the number of trackside equipment is decreased, and the amount of information needing to be maintained by the train is small relative to the ZC;

(2) the train directly calculates the movement authorization through the information of the preceding train, thereby having higher instantaneity; and (3) the intelligence level of the on-board equipment is higher, the manner that the train autonomously calculates the tracking interval is more flexible compared with that of the ZC, and the efficiency can be further improved while safety protection is achieved.

The objective of the present disclosure is to provide a solution for autonomous preceding train identification of a train-train communication system. The preceding train identification is a necessary condition to achieve train tracking in the train-train communication system, the online train identifies the positions of peripheral trains and calculates a tracking interval, so that the running safety of the train can be effectively protected, and the running efficiency of the train is improved.

The embodiment of the present disclosure provides a relatively simple and convenient preceding train identification method. The train identifies the ID of the preceding train on the existing system configuration of the train-train communication without increasing other additional equipment, that is, the train communicates with the preceding OC to identify online trains in the preceding OC.

Figure 1:
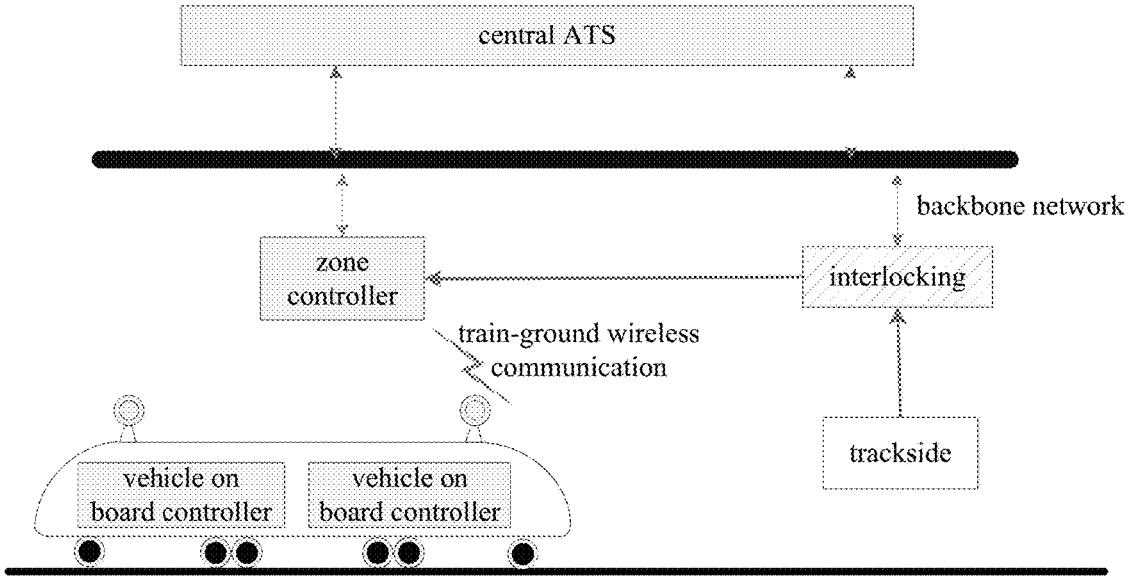
FIG. 1 is a structural schematic diagram of a CBTC system in the prior art.
Figure 2:
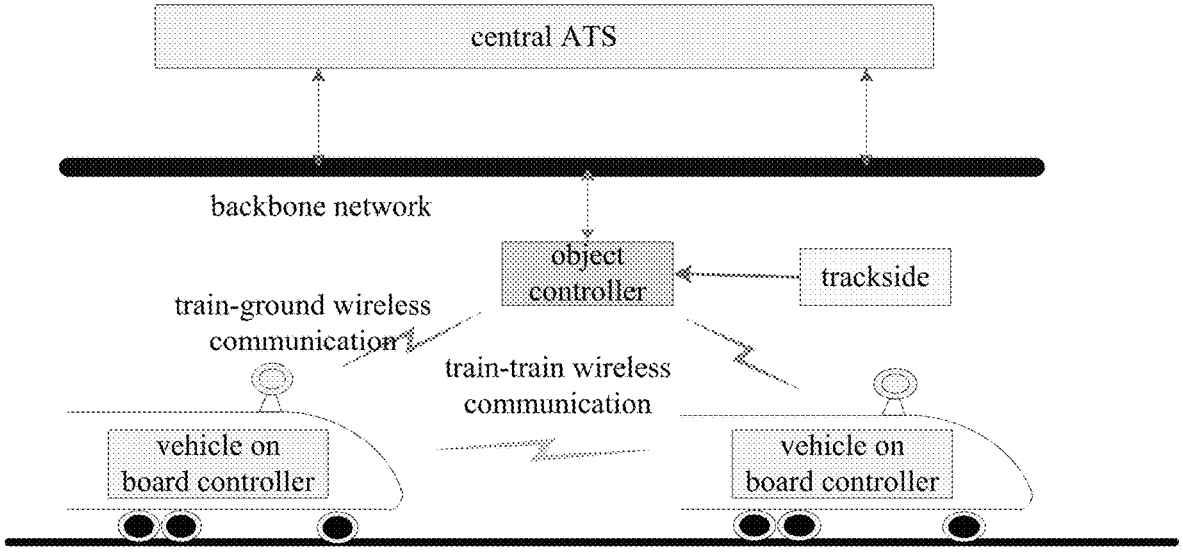
FIG. 2 is a structural schematic diagram of a train running control system of existing train-train communication.
Figure 3:
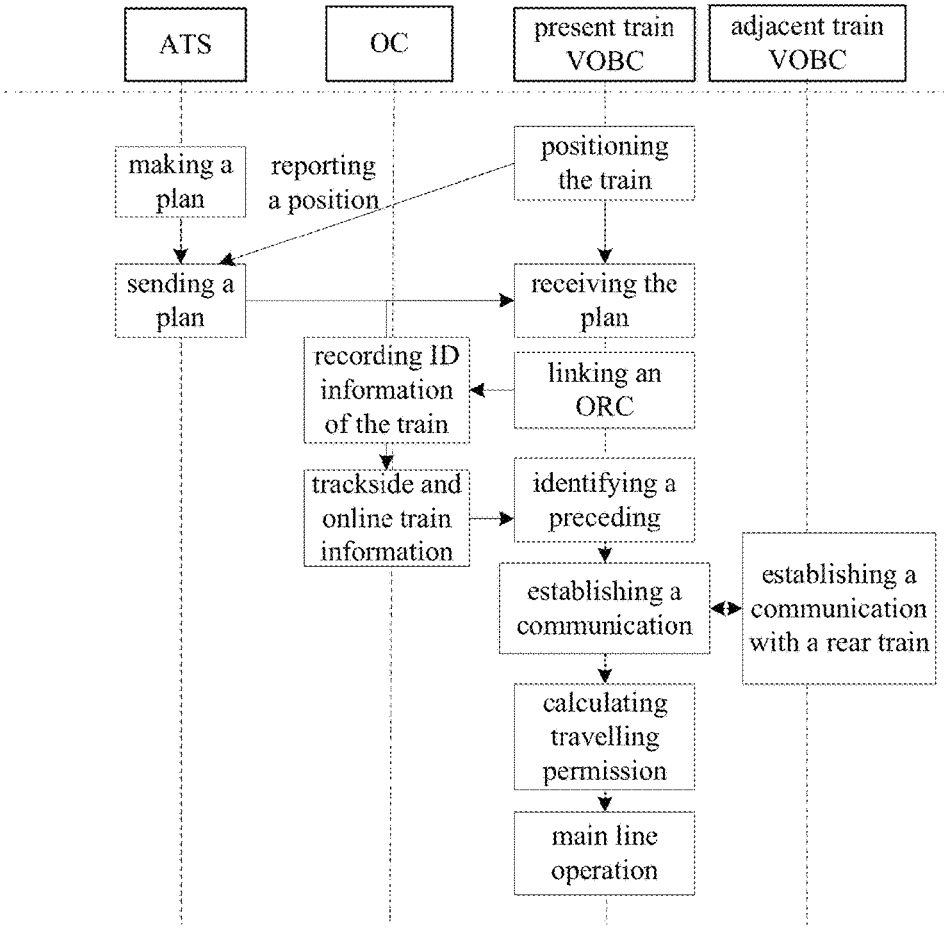
FIG. 3 is a schematic diagram of a working process of a train running control system based on train-train communication.
Figure 4:
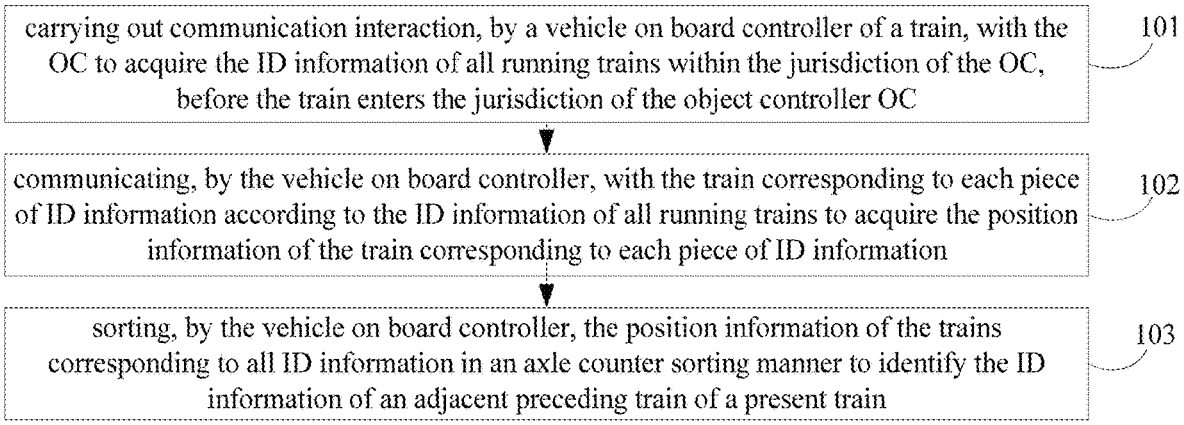
FIG. 4 is a schematic flow diagram of a preceding train identification method based on an object controller provided by an embodiment of the present disclosure.

As shown in FIG. 3 and FIG. 4, wherein FIG. 3 shows a schematic diagram of a working process of a train running control system based on train-train communication, and FIG. 4 shows a schematic flow diagram of a preceding train identification method based on an object controller provided by an embodiment of the present disclosure. The method in the embodiment includes the following steps:

101. A vehicle on board controller of a train carries out communication interaction with the OC to acquire the ID information of all running trains within the jurisdiction of the OC, before the train enters the jurisdiction of the object controller OC.

102. The vehicle on board controller communicates with the train corresponding to each piece of ID information according to the ID information of all running trains to acquire the position information of the train corresponding to each piece of ID information.

103. The vehicle on board controller sorts the position information of the trains corresponding to all ID information in an axle counter sorting manner to identify the ID information of an adjacent preceding train of a present train.

In the preceding train identification method in the embodiment, after the adjacent preceding train is identified, the vehicle on board controller can establish the communication connection with the identified adjacent preceding train to acquire the running state information of the adjacent preceding train. Therefore, the train autonomously calculates the movement authorization to control the train running interval more flexibly, and the running efficiency of the train can be improved.

It can be understood that, in the foregoing step 101, the vehicle on board controller of the present train carries out communication interaction with the OC to acquire axle counter information and other related information within the jurisdiction of the OC, such as the number of trains, train identifiers, train running states, etc. The interactive information of the vehicle on board controller and the OC is not limited in the embodiment.

In the embodiment, an information source of a communication object is required for the train-train communication, that is, the train needs to know the ID information of the communication object, and the object controller perfectly solves the problem of the information source.

At present, the OC maintains the idle information occupied by a route axle counter section, the train needs to keep periodic communication with the OC when running on the route, therefore the OC must have the information of all trains communicating with the same, and thus if the OC is used as the information source of the train identification object, the information of all communication trains within the jurisdiction of the OC can be identified. After communicating with the online trains within the jurisdiction of the OC to acquire the positions of the online trains, the train sorts the positions of the online trains, and determines the position of the preceding train by search.

The aforementioned method is mainly used for realizing the tracking operation of the train in the train-train communication manner, which decreases dependence on trackside equipment, so the number of the trackside equipment is decreased. The train autonomously calculates the movement authorization to control the train running interval more flexibly, and the running efficiency of the train can be improved.

Figure 5:
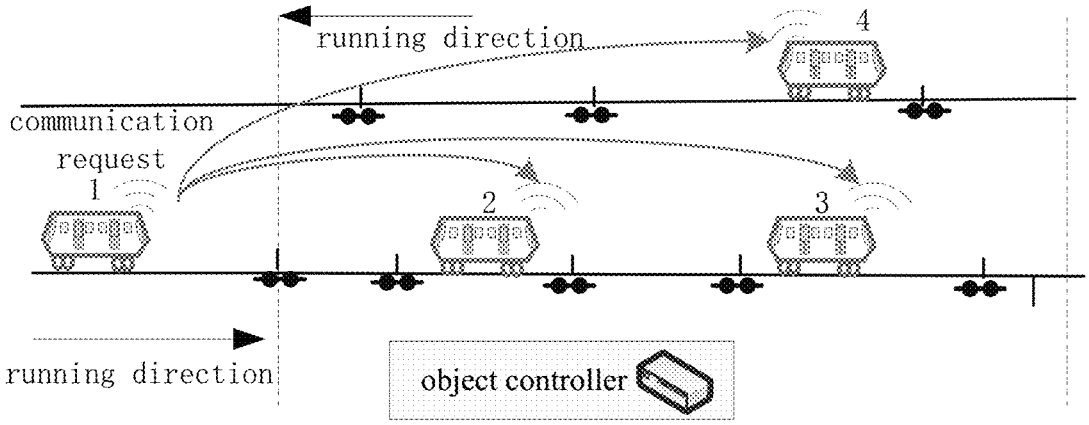
FIG. 5 is a schematic diagram of online train identification provided by an embodiment of the present disclosure.

Optionally, as shown in FIG. 5, in an optional implementation, the foregoing step 101 can include the following sub-step 1011 to sub-step 1013, which are not shown in the figure:

1011. the vehicle on board controller of the train establishes a communication connection with the OC, wherein the ID information of all trains running within the jurisdiction of the OC is stored in the OC.

For example, the vehicle on board controller can determine the identification information of a next OC adjacent to the present OC during running on the route according to electronic map information; and establishes the communication connection with the OC according to the identification information of the next OC.

That is to say, the vehicle on board controller can acquire the identification information of the OC that is about to enter the jurisdiction in advance to further establish the communication connection.

1012. The vehicle on board controller sends a request of acquiring the ID information of all running trains within the jurisdiction of the OC to the OC; and

1013. the vehicle on board controller receives a response including the ID information of all running trains returned by the OC according to the request, and acquires the ID information of all running trains within the jurisdiction of the OC.

At present, in a train-train communication environment without trackside ZC, the train needs to initiatively identify the route state and autonomously calculates a safe travelling range when running on the route. Therefore, before the train enters the jurisdiction of the OC, it needs to acquire the route information from the OC and screen the information to acquire the preceding route state information.

By means of the aforementioned manner, the OC maintains the communication with all trains running within the jurisdiction of the OC, the ID names, namely the ID information of all communication objects will be stored in the OC, and the IDs of the communication objects are trimmed to acquire an ID list of all trains that communicate with the OC at present, which is as shown in the following table 1.

After acquiring the ID list in Table 1, the present train 1 can know the number of communication trains running within the jurisdiction of the OC at present and can inquire the ID addresses of the trains according to the IDs in the table to accomplish online train identification.

TABLE 1

| Online train list in OC | |
|---|---|
| Communication object | Communication object ID |
| Train 1 | VOBC1 |
| Train 2 | VOBC2 |
| Train 3 | VOBC3 |
| Train 4 | VOBC4 |

That is to say, after establishing the communication with the OC, the present train 1 in FIG. 5 can also acquire the information of all communication trains that are communicating with the OC at present while acquiring the section occupation information within the jurisdiction of the OC. For example, before entering the jurisdiction of the OC, the train 1 establishes the communication with the OC to acquire a communication train list ID listed in the OC as shown in Table 1.

The method shown in FIG. 3 to FIG. 5 is realized on the basis that the train establishes communication with the object controller, the existing object controller is arranged at the trackside to collect trackside information and control the trackside equipment, and the train acquires the route information within the jurisdiction of the object controller and determines the ID information of all trains within the jurisdiction of the object controller after establishing the communication with the object controller. The position information of the object controller and the functions of the object controller are not changed in the embodiment.

Figure 6A:
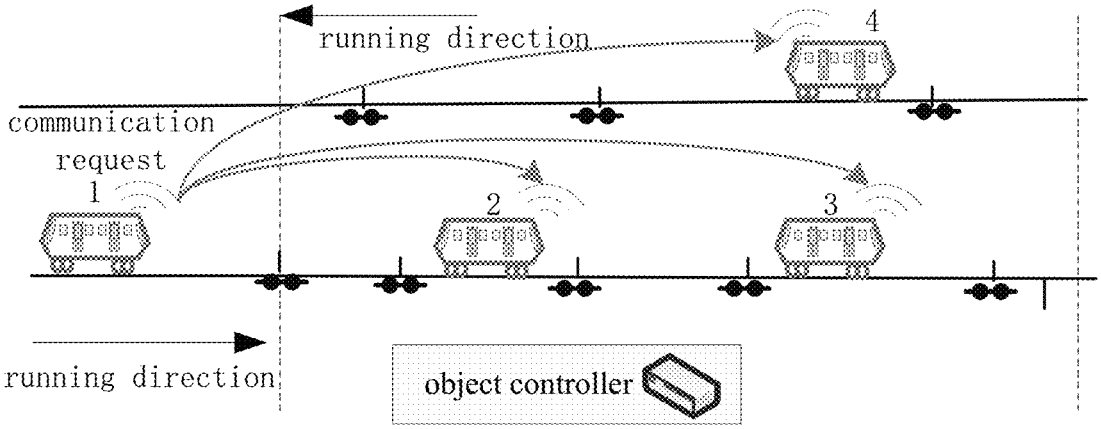
FIG. 6A and FIG. 6B are respectively schematic diagrams of communication of a preceding train provided by an embodiment of the present disclosure with online trains within the jurisdiction of the OC.
Figure 6B:
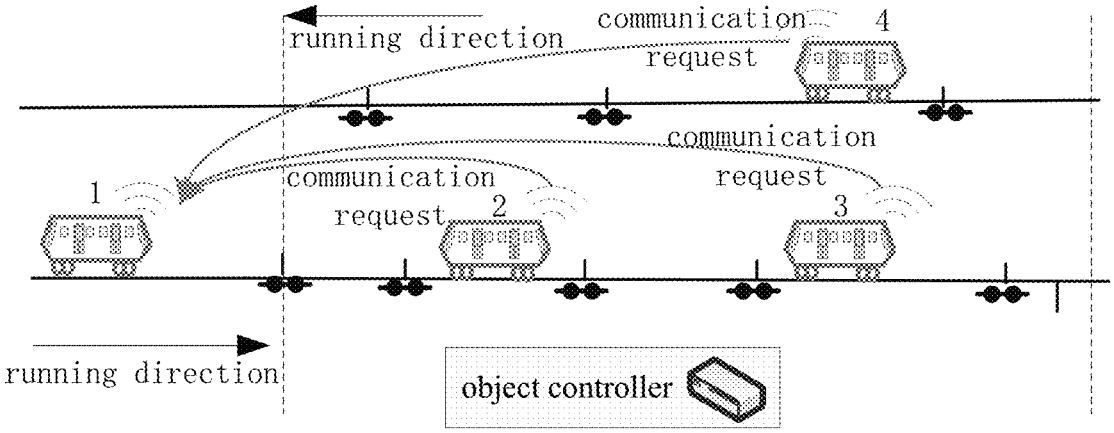

For example, as shown in FIG. 6A and FIG. 6B, the foregoing step 102 can include the following sub-step 1021 to sub-step 1022, which are not shown in the figures:

1021. the vehicle on board controller sends a communication request of acquiring the position information of the train to the train corresponding to the ID information in view of each piece of ID information of all running trains; and

1022. the vehicle on board controller receives communication reply information returned by the train corresponding to the ID information according to the communication request.

The communication reply information in the embodiment can include the ID information of the train and axle counter offset information of the train.

Or, the communication reply information can include the ID information of the train, the axle counter offset information of the train and a running direction of the train.

Typically, a track axle counter is arranged on a track for detecting the number of axles of a train passing through a certain point (an axle counter point) on the track, in order to check the space condition between two axle counter points or in a track section, or judge the time of the train passing through the axle counter point. A sensor on each train can interact with the track axle counter to determine the axle counter offsets of the head and the tail of the train.

In the embodiment, the axle counter offset information of the train can include the axle counter offset information of the head of the train and the axle counter offset information of the tail of the train.

In the train-train communication system, the trains can communicate with each other through the communication request and the communication reply manner. In a similar call-answer manner, after the train sends the communication request to other trains, the train receiving the communication request will send a communication reply to the initiator of the communication request, and the train not receiving the communication request will not send the communication reply.

Herein, the train accomplishing the online train identification initiates the communication request to the online trains within the jurisdiction of the OC according to the IDs of the online trains for acquiring the position information of the online trains; after receiving the communication request, the online trains will correspondingly send communication replies to the initiator of the communication request. In FIG. 6A and FIG. 6B, the train 1 has successfully acquired the position information of the online trains within the jurisdiction of the OC and the axle counter offset information of all online trains.

Figure 7:
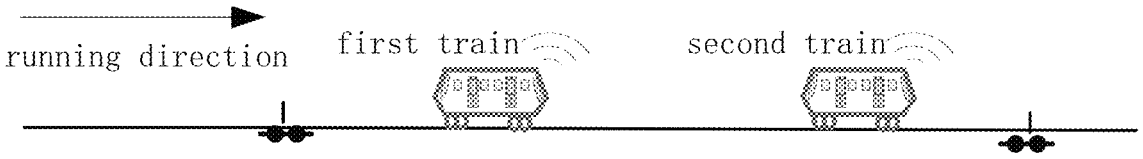
FIG. 7 is a schematic diagram of axle counter sorting of all online trains within the jurisdiction of the OC provided by an embodiment of the present disclosure.

Further, as shown in FIG. 7, if the communication reply information in step 1022 includes the ID information of the train and the axle counter offset information of the train; at this time, step 103 in the foregoing method as shown in FIG. 4 can include the following sub-step 1031 to sub-step 1033:

1031. the vehicle on board controller sorts axle counter information within the jurisdiction of the OC, wherein the axle counter information within the jurisdiction of the OC is acquired by the vehicle on board controller by interacting with the OC in advance.

The sorting the axle counter information within the jurisdiction of the OC in the sub-step can be understood as sorting the position information of all track axle counters on the track within the jurisdiction of the present OC to construct a corresponding virtual track.

1032. The ID information of each train is matched with the sorted axle counter information according to the axle counter offset information of all trains, and a sorting sequence of the trains corresponding to all ID information is determined.

In the sub-step, an approximate position of each corresponding train can be marked on the foregoing constructed corresponding virtual track according to the axle counter offset of each train, and then the sorting sequence of the trains is determined according to the marked approximate position of each train.

1033. The ID information of the adjacent preceding train of the present train is identified according to the sorting sequence of the trains corresponding to all ID information.

It should be noted that only trains running in one direction are within the jurisdiction of the present OC generally, and trains simultaneously running in two directions are very few. Therefore, the aforementioned sub-step 1031 to the sub-step 1033 can be achieved.

In addition, if trains running in two directions are within the jurisdiction of the OC, at this time, since the axle counter offset information of the train includes the axle counter offset of the head of the train and the axle counter offset of the tail of the train, the adjacent preceding train consistent with the running direction of the present train can be well determined according to a position relation of the head and the tail of each train.

In another embodiment, if the communication reply information in sub-step 1022 includes the ID information of the train, the axle counter offset information of the train and the running direction of the train;

at this time, step 103 in the foregoing method as shown in FIG. 4 can include the following sub-step 1031*a* to sub-step 1034*a:*

1031*a*. the vehicle on board controller sorts axle counter information within the jurisdiction of the OC.

In the embodiment, the axle counter information within the jurisdiction of the OC is acquired by the vehicle on board controller by interacting with the OC in advance.

1032*a*. The ID information of the train that is consistent with the running direction of the present train is acquired according to the running directions of all trains.

1033*a*. The ID information of each train having the consistent running direction is matched with the sorted axle counter information according to the ID information of each train having the consistent running direction and the axle counter offset information of the train, and a sorting sequence of the trains corresponding to all ID information is determined.

1034*a*. The ID information of the adjacent preceding train of the present train is identified according to the sorting sequence of the trains corresponding to all ID information.

It can be understood that after the preceding operations of online train identification, communication request sending and communication reply information receiving, the present train needs to process the received online train information and identify the preceding train from the online train information.

In the embodiment, the online train information is processed in a sorting manner based on axle counter, the online trains and the axle counters (track axle counters) within the jurisdiction of the OC are seated by number, the positions of the trains in the axle counters are described by adding train sequences, and the specific sorting method is as follows:

when a train runs within the axle counter section, the train sequence in the axle counter section should store the ID of the train and the train type of the train; and when multiple trains run in the axle counter section, the multiple trains are added from near to far in sequence according to the positions of the trains from the end point of the axle counter section.

As shown in FIG. 7, two trains run in the same axle counter section, and the present vehicle on mount controller determines the sequence of the two trains in the axle counter section according to the position information replied by the trains. Along the running direction supported by the axle counter section, and at this time, the train 1 is in the front and the train 2 is behind in the train sequence of the axle counter.

After accomplishing the sorting, the present train searches forward from the axle counter section where the present train is located to find a first occupied axle counter section in front of the running direction, and matches the first occupied axle counter section with a train sorting result to acquire the first train in the axle counter section, namely the preceding train of the present train. So far, the preceding train identification has been accomplished, based on the identified adjacent preceding train, the present train establishes a communication link with the preceding train to acquire the position, speed, running direction and other information of the preceding train, and calculates the movement authorization in combination with the running information of the present train to track operation of the preceding train, so as to achieve movable block based on train-train communication.

Therefore, the vehicle on board controller of the present train can identify and sort the online trains within the jurisdiction of the OC and find out the adjacent preceding train to achieve the tracking operation at last.

Figure 8:
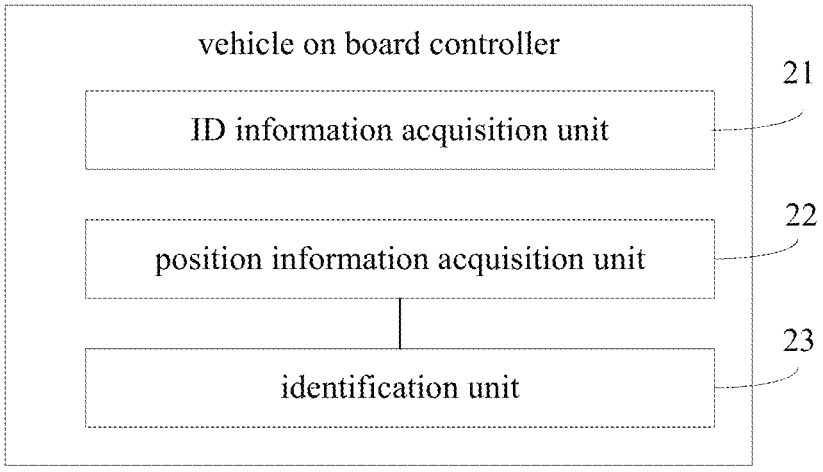
FIG. 8 is a structural schematic diagram of a vehicle on board controller provided by an embodiment of the present disclosure.

As shown in FIG. 8, FIG. 8 shows a structural schematic diagram of a vehicle on board controller provided by an embodiment of the present disclosure. The vehicle on board controller in the embodiment includes an ID information acquisition unit 21, a position information acquisition unit 22 and an identification unit 23;

wherein, the ID information acquisition unit 21 is used for carrying out communication interaction with an OC to acquire the ID information of all running trains within the jurisdiction of the OC, before a train enters the jurisdiction of the object controller OC;

the position information acquisition unit 22 is used for communicating with the train corresponding to each piece of ID information according to the ID information of all running trains to acquire the position information of the train corresponding to each piece of ID information; and the identification unit 23 is used for sorting the position information of the trains corresponding to all ID information in an axle counter sorting manner to identify the ID information of an adjacent preceding train of a present train.

The vehicle on board controller in the embodiment can execute the contents of the foregoing method embodiment, reference can be made to the aforementioned statements, and no detailed description will be given herein.

In addition, the embodiment of the present invention further provides a train, including a train body and any aforementioned vehicle on board controller mounted on the train body.

In the solution of the embodiment, the property that the object controller must need to communicate with the train is grasped, and the preceding train identification based on the object controller is achieved by mining the information in the object controller on the premise of not changing the basic functional structure of the object controller. Further, the trains are identified based on direct train-train communication, compared with the train-ground communication manner, the communication delay is low, the instantaneity is high, and more flexible running interval control is achieved to improve the running efficiency of track traffic.

Those skilled in the art can understand that although some embodiments herein include some features included in other embodiments rather than other features, the combinations of the features of different embodiments are intended to fall within the scope of the present disclosure and form different embodiments.

Those skilled in the art can understand that the steps in the embodiments can be achieved by hardware, or by a software module running on one or more processors, or by a combination thereof. Those skilled in the art can understand that some or all functions of some or all components according to the embodiments of the present disclosure are achieved by using a microprocessor or a digital signal processor (DSP) in practice. The present disclosure can also be implemented to execute some or all equipment or device programs (for example, computer programs and computer program products) of the method described herein.

Although the embodiments of the present disclosure have been described in combination with the accompany drawings, those skilled in the art can make various modifications and variations without departing from the spirit and scope of the present disclosure, and these modifications and variations all fall within the scope defined by the appended claims.

What is claimed is:

1. A preceding train identification method based on an object controller (OC), comprising:

carrying out communication interaction, by a vehicle on board controller of a present train, with the OC to acquire identification (ID) information and axle counter offset information of all running trains within a jurisdiction of the OC, before the present train enters the jurisdiction of the OC;

communicating, by the vehicle on board controller, with a train corresponding to each piece of ID information according to the ID information of all running trains to acquire the position information of the train corresponding to each piece of ID information; and sorting, by the vehicle on board controller, the position information of the running trains corresponding to all ID information to identify the ID information of an adjacent preceding train of the present train by:

sorting axle counter information within the jurisdiction of the OC, wherein the axle counter information within the jurisdiction of the OC is acquired by the vehicle on board controller by interacting with the OC in advance;

matching the ID information of each train with the sorted axle counter information according to the axle counter offset information, and determining a sorting sequence of the running trains; and identifying the ID information of the adjacent preceding train of the present train according to the sorting sequence of the running trains, wherein the axle counter offset information of each train comprises an axle counter offset of the head of the train and the axle counter offset of the tail of the train.

2. The method of claim 1, wherein the step of carrying out communication interaction, by a vehicle on board controller of a present train, with the OC to acquire ID information and axle counter offset information of all running trains within a jurisdiction of the OC comprises:

establishing, by the vehicle on board controller, a communication connection with the OC, wherein the ID information of all trains running within the jurisdiction of the OC is stored in the OC;

sending, by the vehicle on board controller, a request of acquiring the ID information of all running trains within the jurisdiction of the OC to the OC; and receiving, by the vehicle on board controller, a response including the ID information of all running trains returned by the OC according to the request, and acquiring the ID information of all running trains within the jurisdiction of the OC.

3. The method of claim 2, wherein after the step of acquiring the ID information of all running trains within the jurisdiction of the OC, the method further comprises:

acquiring the axle counter information within the jurisdiction of the OC.

4. The method of claim 3, wherein the step of communicating, by the vehicle on board controller, with a train corresponding to each piece of ID information according to the ID information of all running trains to acquire the position information of the train corresponding to each piece of ID information comprises:

sending, by the vehicle on board controller, a communication request of acquiring the position information of the train to the train corresponding to the ID information in view of each piece of ID information of all running trains; and receiving, by the vehicle on board controller, communication reply information returned by the train corresponding to the ID information according to the communication request, wherein the communication reply information comprises the ID information of the train and the axle counter offset information of the train; or the communication reply information comprises the ID information of the train, the axle counter offset information of the train and a running direction of the train.

5. The method of claim 4, wherein if the communication reply information comprises the ID information of the train, the axle counter offset information of the train and the running direction of the train;

the step of sorting, by the vehicle on board controller, the position information of the trains corresponding to all ID information to identify the ID information of an adjacent preceding train of the present train comprises:

acquiring the ID information of the train that is consistent with the running direction of the present train according to the running directions of all trains;

matching the ID information of each train having the consistent running direction with the sorted axle counter information according to the ID information of each train having the consistent running direction and the axle counter offset information of the train, and determining a sorting sequence of the trains corresponding to all ID information; and identifying the ID information of the adjacent preceding train of the present train according to the sorting sequence of the trains corresponding to all ID information.

6. The method of claim 1, further comprising:

establishing, by the vehicle on board controller, a communication connection with the identified adjacent preceding train to acquire the running state information of the adjacent preceding train.

7. The method of claim 2, wherein the step establishing, by the vehicle on board controller, a communication connection with the OC comprises:

determining, by the vehicle on board controller, identification information of a next OC adjacent to the present OC during running on the route according to electronic map information; and establishing the communication connection with the OC according to the identification information of the next OC.

8. A vehicle on board controller, comprising:

an identification (ID) information acquisition unit, used for carrying out communication interaction with an object controller (OC) to acquire the ID information and axle counter offset information of all running trains within a jurisdiction of the OC, before a present train installed with the vehicle on board controller enters the jurisdiction of the OC;

a position information acquisition unit, used for communicating with a train corresponding to each piece of ID information according to the ID information of all running trains to acquire the position information of the train corresponding to each piece of ID information; and an identification unit, used for sorting the position information of the running trains corresponding to all ID information to identify the ID information of an adjacent preceding train of the present train by:

sorting axle counter information within the jurisdiction of the OC, wherein the axle counter information within the jurisdiction of the OC is acquired by the vehicle on board controller by interacting with the OC in advance;

matching the ID information of each train with the sorted axle counter information according to the axle counter offset information, and determining a sorting sequence of the running trains; and identifying the ID information of the adjacent preceding train of the present train according to the sorting sequence of the running trains, wherein the axle counter offset information of each train comprises an axle counter offset of the head of the train and the axle counter offset of the tail of the train.

9. A train, comprising a train body and the vehicle on board controller of claim 8 located on the train body.

* * * * *